US005791104A

United States Patent [19]

Baier et al.

[11] Patent Number: 5,791,104

[45] Date of Patent: Aug. 11, 1998

[54] JAMB EXTENSION ASSEMBLY FOR DOORS AND WINDOWS

[75] Inventors: Bruce Baier; Dave Cody; Gene De Boef, all of Pella; Mearl J. Minter, Oskaloosa; Merlan Rolffs, Pella, all of Iowa

[73] Assignee: Pella Corporation, Pella, Iowa

[21] Appl. No.: 566,061

[22] Filed: Dec. 1, 1995

[51] Int. Cl.[6] ..... E06B 1/04

[52] U.S. Cl. ..... 52/217; 49/505; 52/98; 52/204.56; 52/213; 52/730.5; 52/734.2

[58] Field of Search ..... 52/98, 99, 100, 52/204.1, 204.5, 204.56, 204.62, 204.7, 206, 208, 213, 217, 730.3, 730.4, 730.5, 730.6, 731.9, 734.1, 734.2, 738.1, 309.16; 49/504, 505

[56] References Cited

U.S. PATENT DOCUMENTS

| | | | |
|---|---|---|---|
| 2,902,727 | 5/1959 | Samolis | 52/217 X |
| 3,694,961 | 10/1972 | Johnson | 49/505 X |
| 3,703,063 | 11/1972 | Budich et al. | 52/204.1 X |
| 4,272,931 | 6/1981 | Stauizzo | 52/98 |
| 4,328,644 | 5/1982 | Scott et al. | 52/734.1 X |
| 4,682,451 | 7/1987 | Hubble | 52/217 X |
| 4,782,630 | 11/1988 | Kleyn | 52/217 X |
| 4,787,184 | 11/1988 | Boidron | 52/217 |
| 4,793,114 | 12/1988 | Pacca | 52/204.5 |
| 4,873,803 | 10/1989 | Rundo | 52/208 X |
| 5,157,881 | 10/1992 | Tashman et al. | 52/98 |
| 5,293,723 | 3/1994 | Slessor | 52/204.1 X |
| 5,345,722 | 9/1994 | McKann | 52/217 X |
| 5,392,574 | 2/1995 | Sayers | 52/204.56 X |
| 5,435,106 | 7/1995 | Garries et al. | 52/204.5 |
| 5,491,940 | 2/1996 | Bruchu | 52/734.2 X |
| 5,528,869 | 6/1996 | Boomer et al. | 52/217 X |
| 5,619,828 | 4/1997 | Ver Meer | 52/204.1 X |

*Primary Examiner*—Carl D. Friedman
*Assistant Examiner*—Kevin D. Wilkens
*Attorney, Agent, or Firm*—Hovey, Williams, Timmons & Collins

[57] ABSTRACT

A window unit (20) including a jamb extension assembly (28) is provided for use with fenestration products. The jamb extension assembly (28) includes a frame member (30) having structure to permit installation of the window unit (20) in a building wall rough opening. The frame member (30) presents inner, outer, rearward and forward portions (62, 64, 66, 68), and includes a jamb extender receiving slot (70) extending and opening rearwardly from the rearward portion (66) of the frame member (30). An elongated jamb extender (32) is provided and includes a transverse, extender flange (88) extending forwardly from an extender corner, and a trim flange (92) extending outwardly from the corner. The extender flange (88) is configured to slide in the slot (70). The extender flange (88) includes structure defining a plurality of longitudinally disposed lines of weakness being in the form of scores (94) disposed on an outer flange surface (96) to permit the length adjustment of the extender flange (88). The slot (70) is configured to conceal any gap (102) created between the forward edge (112) of the extender flange (88) and the rearward frame portion (66) when the extender flange (88) is disposed in the slot (70).

26 Claims, 3 Drawing Sheets

JAMB EXTENSION ASSEMBLY FOR DOORS AND WINDOWS

BACKGROUND OF THE INVENTION

1. Field of the Invention

The present invention is broadly concerned with fenestration products such as prefabricated window and door products having structure to facilitate site installation in a building wall. More particularly, the invention pertains to such products improved by the provision of a jamb extension assembly which may be easily employed to trim windows installed in rough wall openings in a building wall at a work site. The invention also pertains to such products improved by the provision of a mullion reinforcing bar for installation between adjacent products.

2. Background of the Invention

During the installation of prefabricated doors and windows (otherwise known as fenestration products), problems are encountered because a wall into which a prefabricated door or window is to be installed may have excessive wall tolerances (e.g., plus or minus 1/16 inch). Excessive wall tolerances may be due to such factors as the use of wet or dry wood wall studs, bowed wall studs, varying sheeting and sheetrock tolerances, and varying tolerances from different construction trades. The result is that the thickness of the wall into which the door or window is to be located often varies. To accommodate the varying wall thicknesses when installed doors and windows are trimmed, precise interior woodworking is required, which in turn requires the use of skilled tradesman to perform precise woodworking, substantially increasing the cost of construction.

Trim assemblies have been provided in the past to simplify window trimming where jamb-surface widths vary. (As used herein, the term "jamb surface" means the inner surface of the window opening perpendicular to the wall and projecting toward the window.) Such conventional trim assemblies, however, also suffer disadvantages. Assemblies such as that disclosed in U.S. Pat. No. 4,272,931, involved the use of L-shaped cross-section trim members. One leg of the L is adapted to be attached to the wall while the other leg of the L (flange section) serves to be attached to the jamb surface of the window opening. The jamb surface flange member was provided with grooves to permit the flange section width to be readily modified to accommodate varying jamb surface widths. A problem arises, however, because the discrete spacing of the grooves, used as "break-off" delineators when adjusting flange length, provide only for discrete flange length variation. The result is that the discrete groove spacing may not allow the flange length to be adjusted to exactly correspond to the jamb surface length. Thus, when the trim member, with an adjusted length, is installed with the casement member abutting the interior wall, an unsightly gap often remains between the flange end and the window frame, exposing the jamb surface.

In addition, other problems arise when conventional window products are installed in a side-by-side relationship. So installed, windows often require costly mullion reinforcing if the unit window opening site lines are to remain the same. Such reinforcement is required for stability and to accommodate wind loading.

There is, therefore, a need in the art for an improved jamb assembly for use with fenestration products which can be easily adjusted for all jamb widths so that the window can be easily trimmed without unsightly gaps remaining that expose jamb surfaces. There is additionally a need for an improved jamb extension assembly including a frame which, when installed in side-by-side relationship with another identical assembly, provides for a mullion reinforcement using the same unit site lines.

SUMMARY OF THE INVENTION

The present invention overcomes the problems outlined above, and it provides an improved jamb extension assembly for doors and windows. Broadly speaking, the jamb extension assembly of the instant invention is adjustable to virtually any jamb surface width and can accommodate virtually all wall tolerances. A jamb extender member of the jamb extension assembly is installed in a window unit (single or composite) in a wraparound mode which allows for factory cutting to length per unit size.

The jamb extension assembly of the invention is provided for use with fenestration products including conventional window assembly design. The jamb extension assembly includes a frame having structure to permit installation of the window unit in a building wall rough opening. The frame member presents forward, rearward, inner, and outer portions, and includes a jamb extender receiving slot extending and opening rearwardly from the rearward portion of the frame member. An elongated jamb extender is provided and includes a transverse, extender flange extending forwardly from an extender corner, and a trim flange extending outwardly from the corner. The extender flange is configured to slide in the slot. The extender flange includes structure defining a plurality of longitudinally disposed lines of weakness being in the form of scores disposed on an outer flange surface to permit the length adjustment of the extender flange. The slot is configured to conceal any gap created between the forward end of the extender flange and the rearward frame portion when the extender flange is disposed in the slot.

DETAILED DESCRIPTION OF THE PREFERRED EMBODIMENTS

Figure 2:
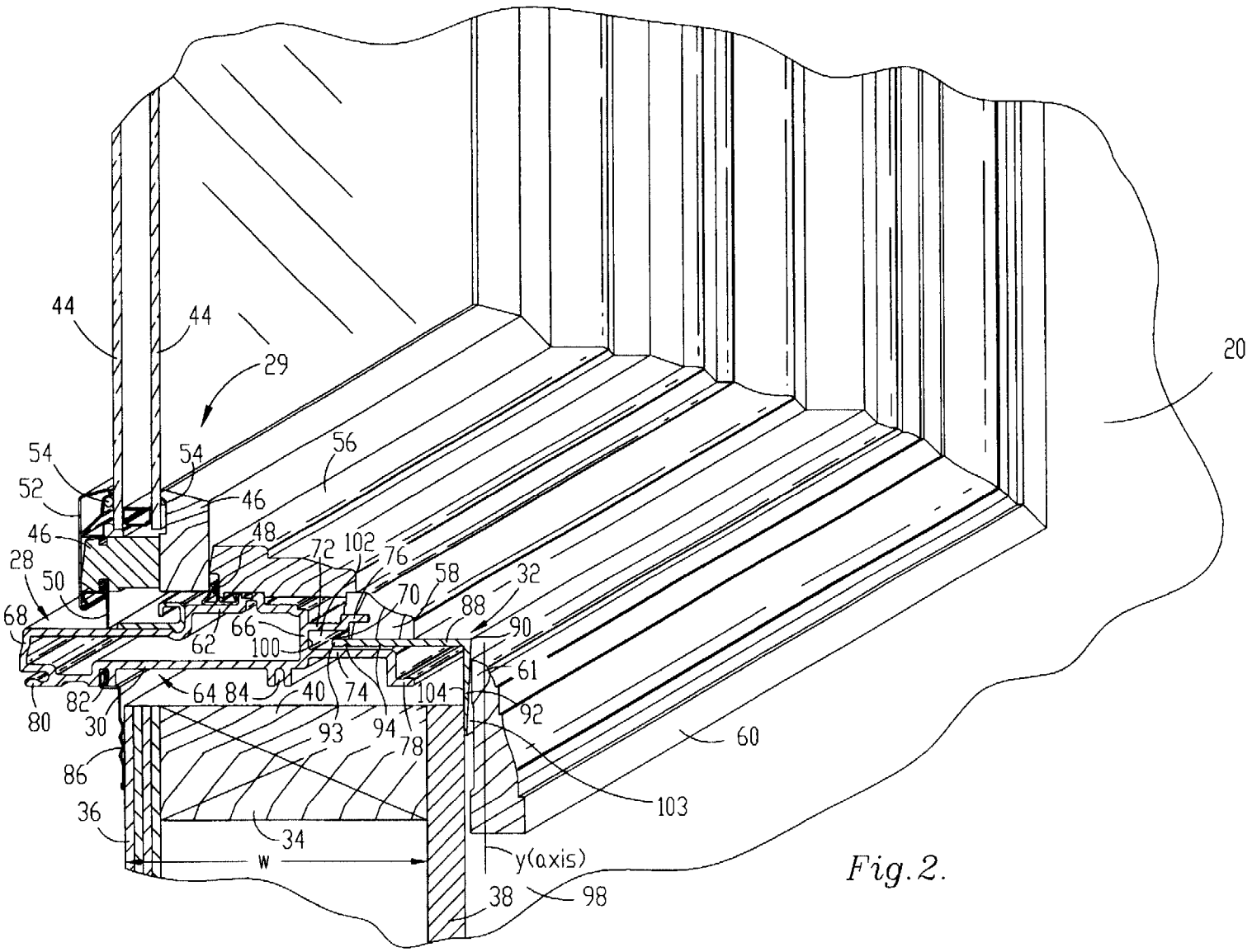
FIG. 2 is a fragmentary, vertical, isometric, partial section illustrating the jamb extension assembly in accordance with the invention, equipped with the frame member and jamb extension member, with window trim installed.

In order to facilitate the description of the jamb extension assembly of the present invention in connection with FIG. 2 of the drawings, the following designations will be used in the Specification and Claims: the left side of FIG. 2 will be the "front" or "forward" portion thereof; the right side the "rear" or "rearward" portion; the bottom is the "outside" or "outer" portion thereof; and, the top the "inside" or "inner" portion. Hence, an element extending from right to left would be "forwardly extending," and one extending from left to right "rearwardly extending." In a like manner, an element extending from the upper portion of the frame to the lower would extend "outwardly," and one extending from the lower to the upper portion "inwardly."

Figure 1:
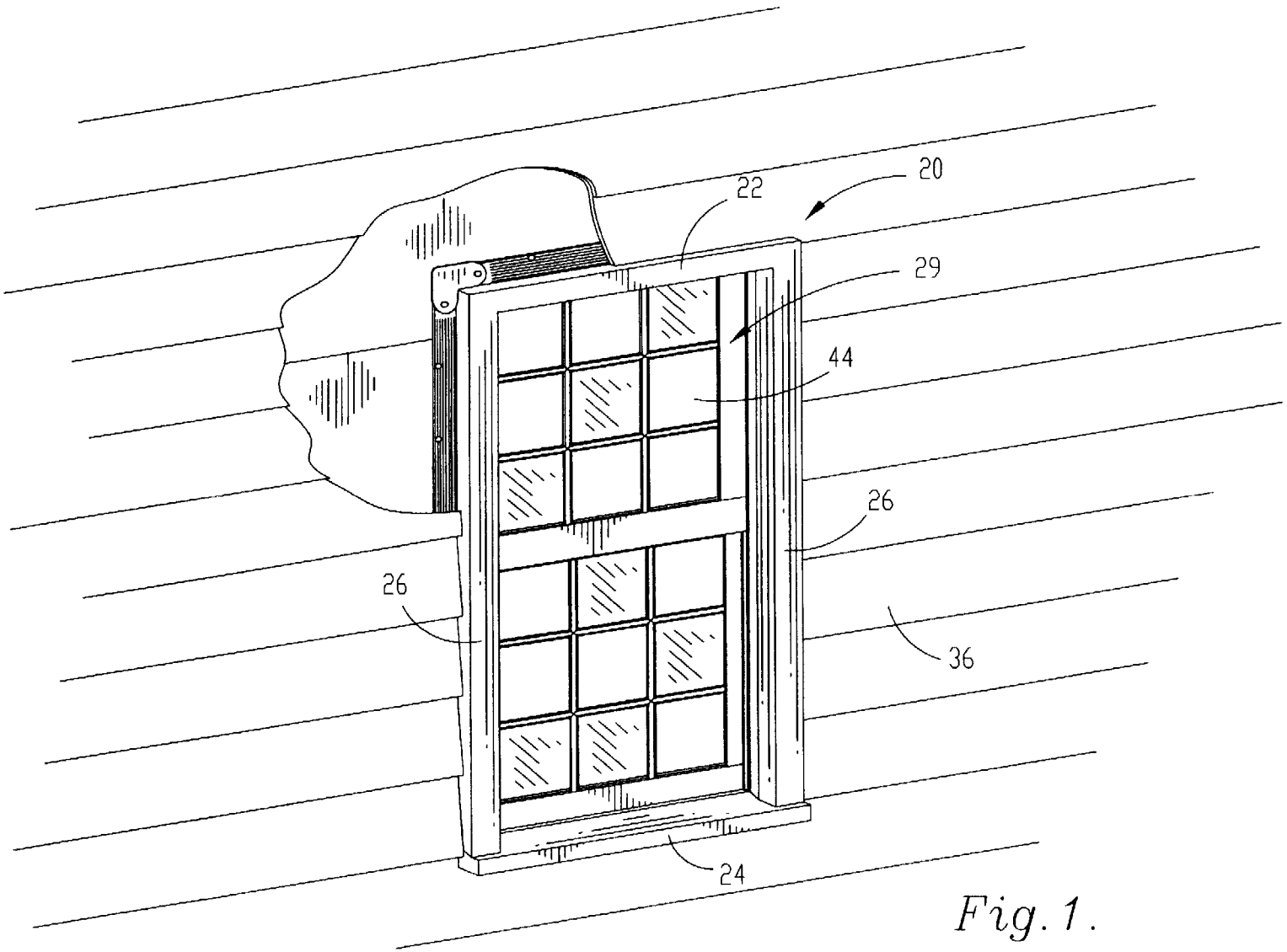
FIG. 1 is a isometric view with parts broken away, illustrating an installed window unit incorporating an improved jamb extension assembly of the invention.

Turning now to the drawings, there is shown in FIG. 1 a segmented window frame joined together to form a window unit 20. The assembly 20 is formed of a head member 22, a sill member 24, and a pair of mutually opposed side jamb members 26. Each of the members are typically constructed of extruded aluminum and are attached to the outside building wall by conventionally means.

Figures 3, 4, 5, 6, 7:
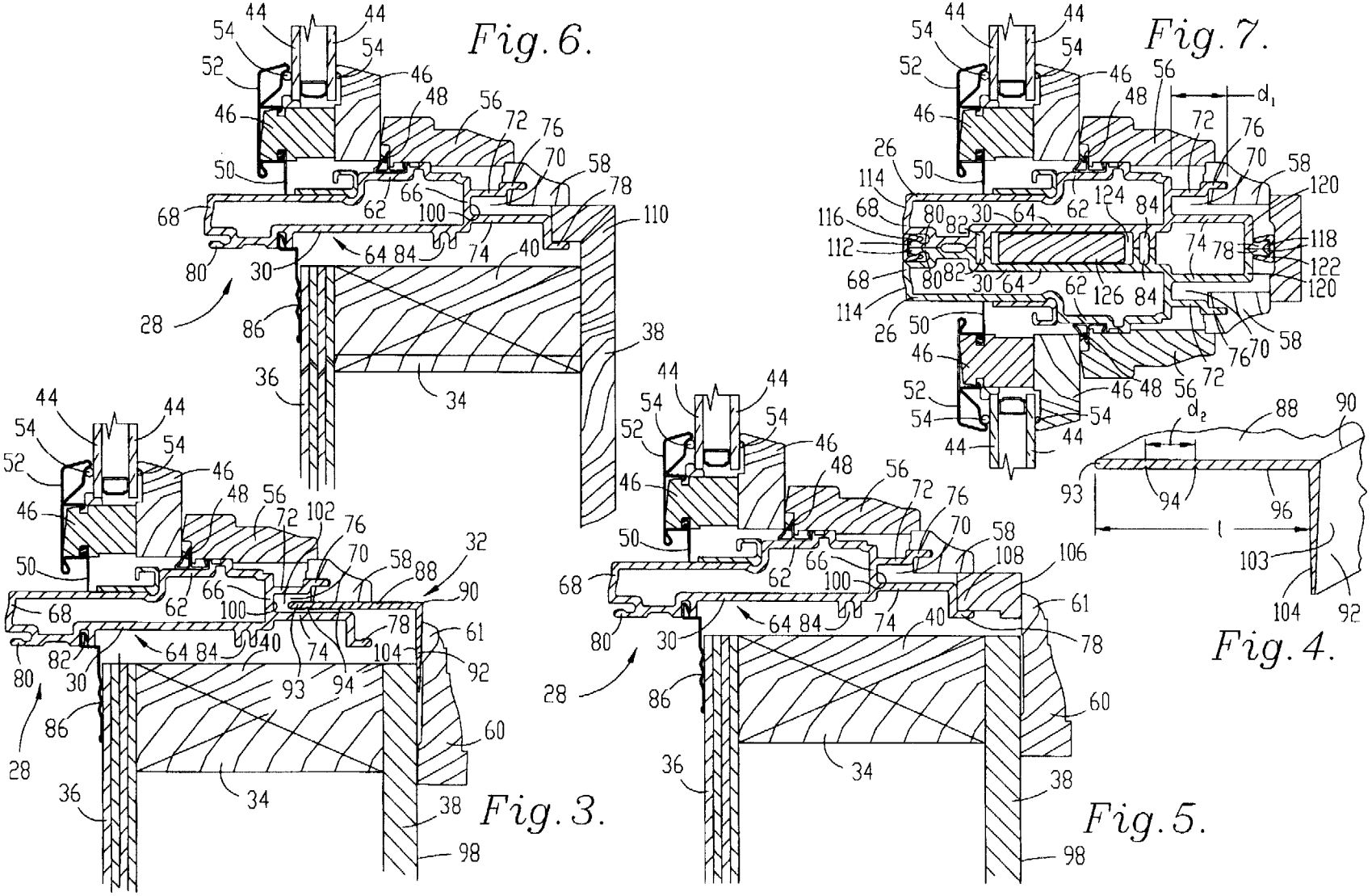
FIG. 3 is a fragmentary, sectional view with parts broken away illustrating an installed window unit with a jamb extension assembly in accordance with the invention, and illustrating the use of the jamb extension member to conceal the jamb surface.
FIG. 4 is an isometric view of the elongated jamb extender illustrating the tapered trim flange.
FIG. 5 is a fragmentary, vertical, sectional view illustrating an alternative embodiment of the jamb extension assembly in accordance with the invention, equipped with the frame member and wood trim used in lieu of a jamb extension member.
FIG. 6 is a fragmentary, vertical, sectional view illustrating the jamb extension assembly in accordance with the invention, equipped with the frame member and a sheetrock return configuration used in lieu of a jamb extension member.
FIG. 7 is a fragmentary, plan, sectional view illustrating jamb extension assemblies installed with the jamb rail portions in side-by-side relationship, and illustrating the reinforcing bar channel formed between the frame members.

Each member is individually comprised of a jamb assembly 28 of the instant invention and a conventional window assembly 29. Referring to FIGS. 2 and 3, it will be seen that the jamb extension assembly 28 comprises two basic elements, namely: the frame member 30 and the elongated jamb extender 32. The jamb extension assembly 28 is attached within a rough window opening formed in a building wall between wooden or metal studs 34, the wall having an exterior wall 36, an interior wall 38, a jamb surface 40 with a jamb surface width "w".

The window assembly 29 is supported by the jamb extension assembly 28 and the window assembly 29 includes insulated glass 44, sash members 46, weather stripping 48, rain stripping 50, prefinished sash cladding 52, and seacant members 54, all of convention design and all assembled by conventional methods to the jamb extension assembly 28. Also shown in FIG. 2 are stops 56, frame trim 58 and window trim 60 having a transverse axis "y", presenting an inner portion 61, all of conventional design and assembled by conventional methods.

Referring now in particular to FIG. 2 of the drawings where the jamb extender assembly 28 is shown in detail, frame member 30 includes inner portion 62, outer portion 64, rearward portion 66, and forward portion 68. A jamb-extension receiving slot 70 extends and opens rearwardly from rearward frame portion 66 and includes inner and outer slot flanges 72 and 74 that are integral with rear portion 66 and are in spaced parallel relationship to one another. Flanges 72 and 74 are between about 0.032 and 0.50 inch, typically about 0.25 inch, in overall length. In the preferred embodiment, both slot flanges 72 and 74 are Z-shaped and include offset portions 76 and 78, respectively. The depth "$d_1$" of slot 70 (see FIG. 7) is preferably between about 0.125 and 2.0 inches, and is typically 1.0 inch.

Forward frame member portion 68 presents a clip flange 80 that extends forwardly therefrom, as shown in FIG. 2. Outer frame portion 64 includes forward and rearwardly installation fin receiving slots 82 and 84, into which slots an installation fin 86 may be installed, as shown.

Elongated jamb extender 32 is fabricated of synthetic material, typically plastic, aluminum or composite material, and includes a transverse, extender flange 88 extending forwardly from the jamb extender corner 90, and a trim flange 92 extending outwardly from the corner 90. The jamb extender flange 88 presents a forward edge 93 and is configured to be slidably received by the receiving slot 70 of frame member 30.

Referring to FIG. 4, the length "l" of extender flange 88 may be easily adjusted by means of a plurality of longitudinally disposed lines of weakness which, in the present embodiment, are provided in the form of scores 94 disposed on the outward facing surface 96 of extender flange 88. The scores 94 are in parallel spaced relationship to corner 90 and are configured to permit the easy and selective length adjustment of the extender flange 88 so that its length "l" corresponds roughly to the distance between the rearward surface 98 of interior wall 38 and the rearwardly facing surface 100 of rearward frame portion 66. The length adjustment is made by cutting or breaking off the extender flange 88 at a selected line of weakness or score 94. The length of extender flange 88 may be adjusted either at the factory or at the site. The separation of scores 94 is preferably about 0.25 inches.

Because inner slot flange 72 "overhangs" the extender flange 88 when inserted into slot 70, a relatively large gap 102 may exist between the forward end of the extender flange 88 and the rearward surface 100 of frame member 30 without being noticeable because gap 102 is concealed by inner slot flange 72. As a result, the jamb extender assembly 28 can more easily accommodate greater tolerances in jamb surface widths "w" since gaps 102 up to about 1.0 inch in length will be concealed in slot 70. Furthermore, gaps 102 and forward edge 93 of extender flange 88 are concealed in slot 70 even when the jamb surface width "w" varies by up to about 1.0 inch or by more than 22%. Further, because the invention includes structure which facilitates the concealment of gaps 102, fewer scores 94 are needed on the extender flange 88. Since fewer scores 94 are needed, the invention may be practiced where the distance "$d_2$" between the scores may be greater than about 0.5 inch on an elongated jamb extender 32. Assembly 28 is preferably configured for jamb surface variations of plus or minus 0.50 inches. Further, slot flanges 72 and 74 have a preferred length of between about 0.125 and 0.75 inches.

Trim flange 92 is tapered as shown in FIGS. 2, 3 and 4 and presents a rearward mating surface 103 configured to receive the inner portion 61 of trim 60, as shown in FIG. 2. Trim flange 92 is tapered so that the transverse axis "y" of trim flange 60 remains substantially vertical when installed, as shown in FIG. 2. Trim flange 92 also includes a forward surface 104 configured to engage rearward surface of interior wall 38 when the window unit 20 is installed, as shown.

Referring to FIG. 2, once the elongated jamb extender 32 is installed with its extender flange 88 within slot 70 of frame member 30, stops 56, frame trim 58, and window trim 60 may be easily installed without precise woodworking otherwise required because gaps 102, if present, are hidden from view by slot 70.

FIG. 5 shows an alternative embodiment of the instant invention wherein a wood extension member 106 may be used instead of an elongated jamb extender 32 by disposing its forward portion 108 within the offset portion 78 of outer slot flange 74. This embodiment is selected when it is desirable to omit elongated jamb extender 32 and trim the window completely with wood or other materials.

Referring to FIG. 6, there is shown another embodiment of the instant invention which shows a sheetrock return section 110 disposed within the offset portion 78 of outer slot flange 74, used if a sheetrock/wood trim combination is desired.

FIG. 7 shows yet another embodiment of the invention in which adjacent side jamb portions 26 may be attached together to form side-by-side window construction. In this embodiment, when two side jamb portions 26 are placed in side-by-side relationship, the clip flange 80 of a frame member 30 associated with a jamb member 26 is in mating and coupling contact with an adjancent flange 80 of another frame member 30 forming a forward edge 112 and a first mullion wall 114. Forward edge 112 is locked by means of a forward edge clip 116, constructed preferably of aluminum with a wood covering. In a like manner, offset portion 78 of lower slot flange 74 is similarly in mating and coupling contact with an adjacent flange 74 forming a rearward edge 118 and a second mullion wall 120. Rearward edge 118 is locked together by a rearward clip 122. In such side-by-side relationship, a reinforcing bar channel 124 is formed between corresponding outer portions 64 frame member 30 and corresponding forward and rearward fin receiving slots 82 and 84 as shown in FIG. 7. A reinforcing bar 126 constructed of any suitable material (including extruded aluminum, other metals, wood and conventional synthetic material used for construction materials) may optimally be received within channel 124 to reinforce the construction of the window, allowing, for example, greater wind loading while maintaining the same unit sight lines. When reinforcing bar 126 is installed in channel 124, it has the effect of stiffening window assemblies installed in side-by-side relationship.

We claim:

1. A jamb extensible fenestration apparatus comprising:

a fenestration assembly including a frame presenting a rearward portion and including structure defining a jamb-extension receiving slot opening rearwardly from said rearward portion; and an elongated jamb extender including a trim flange and a transverse, extender flange configured for slidable reception in said slot, said extender flange presenting a width and a forward edge and including means defining a plurality of longitudinal, parallel lines of weakness for allowing portions of said extender flange to be broken away at a selected line of weakness for shortening said extender flange to a selected length, said slot being configured for concealing said forward edge of said extender flange and for concealing any gap between said forward edge and said rearward frame portion when said extender flange is received in said slots, said rearward portion further including structure defining an offset portion adjacent said slot for receiving trim within said offset portion as a selectable alternative to said jamb extender.

2. The apparatus of claim 1, said slot defining structure including inner and outer slot flanges integral with and extending rearwardly from said frame, said inner and outer slot flanges being in parallel spaced relationship to one another and forming said slot therebetween.

3. The apparatus of claim 2, the length of said inner and outer slot flanges being between about 0.032 and 0.50 inch.

4. The apparatus of claim 2, the inner and outer flanges configured so that the depth of said slot is between about 0.125 and 2.0 inches.

5. The apparatus of claim 2, the inner and outer flanges having a Z-shaped configuration to define offset portions.

6. The apparatus of claim 1, said slot configured to conceal a gap created between the end of said extender flange and said rearward frame portion when said extender flange of said elongated jamb extender is inserted into said slot of said frame.

7. The apparatus of claim 6, said gap being about 1.0 inch.

8. The apparatus of claim 1, said elongated jamb extender being constructed of materials selected from the group consisting of plastic, aluminum or composite material.

9. The apparatus of claim 1, said extender flange including scores disposed on an outer flange surface thereof.

10. The apparatus of claim 9, said trim flange and extender flange defining a corner at the juncture thereof, said scores being in parallel spaced relationship with said corner.

11. The apparatus of claim 10, said scores being separated by a distance of about 1.0 inch.

12. The apparatus of claim 1, said assembly configured for jamb surface width variations of up to about 22%.

13. The apparatus of claim 1, said assembly configured for jamb surface depth variations of plus or minus 0.50 inch.

14. The apparatus of claim 1, said assembly frame presenting side jamb members, said jamb members presenting a first forward wall including a forwardly extending flange and a second rearward wall including a rearwardly extending flange, said forwardly and rearwardly extending flanges being configured for mating and coupling with corresponding forwardly and rearwardly extending flanges of an adjacent fenestration assembly to form respective mullion walls, said side portions including structure defining a reinforcing bar channel between said frame side portions; and said channel figured to receive a rigid reinforcing bar received in said channel.

15. A fenestration apparatus comprising:

a plurality of adjacent fenestration assemblies each including a frame presenting side portions, said side portions including a first forward wall including a forwardly extending flange and a second rearward wall including a rearwardly extending flange, said forwardly and rearwardly extending flanges being configured for contacting and for mating with corresponding forwardly and rearwardly extending flanges of an adjacent one of said fenestration assemblies to form respective mullion walls, said side portions including structure defining a reinforcing bar channel between said frame side portions;

a first clip coupling adjacent forwardly extending flanges of adjacent assemblies thereby forming at least a portion of a forward edge of said fenestration apparatus;

a second clip coupling adjacent rearwardly extending flanges of adjacent assemblies thereby forming at least a portion of a rearward edge of said fenestration apparatus; and a rigid reinforcing bar received in said channel, said channel being configured to receive said bar without spacing apart said assemblies.

16. The apparatus of claim 15, said bar formed of extruded aluminum.

17. The apparatus of claim 15, said bar formed of wood.

18. The apparatus of claim 15, said bar formed of synthetic material.

19. The apparatus of claim 15, each of said fenestration assemblies including:

a frame presenting a rearward portion and including structure defining a jamb-extension receiving slot opening rearwardly from said rearward portion; and an elongated jamb extender including a trim flange and a transverse, extender flange configured for slidable reception in said slot, said extender flange presenting a width and a forward edge and including means defining a plurality of longitudinal, parallel lines of weakness for allowing portions of said extender flange to be broken away at a selected line of weakness for shortening said extender flange to a selected length, said slot being configured for concealing said forward edge of said extender flange and for concealing any gap between said forward edge and said rearward frame portion when said extender flange is received in said slot.

20. The apparatus of claim 19, said scores being separated by a distance of about 0.25 inch.

21. The apparatus of claim 19, said assemblies configured for jamb surface width variations of up to 22%.

22. The apparatus of claim 19, said assembly configured for jamb surface depth variations of plus or minus 0.50 inch.

23. The apparatus of claim 19, said slot structure including inner and outer slot flanges integral with and extending rearwardly from said frame, said inner and outer slot flanges being in parallel spaced relationship to one another and forming said slot therebetween.

24. The apparatus of claim 23, the length of said inner and outer slot flanges being between about 0.125 and 0.75 inches.

25. The apparatus of claim 23, the inner and outer flanges configured so that the depth of said slot is between about 0.125 and 0.75 inches.

26. The apparatus of claim 23, the inner and outer flanges having a Z-shaped configuration to define offset portions.

* * * * *